US005739735A

United States Patent [19]

Pyykkö et al.

[11] Patent Number: 5,739,735

[45] Date of Patent: Apr. 14, 1998

[54] FILTER WITH IMPROVED STOP/PASS RATIO

[75] Inventors: Jarmo Pyykkö, Oulu; Kimmo Ervasti, Varjakka, both of Finland

[73] Assignee: LK Products Oy, Kempele, Finland

[21] Appl. No.: 620,276

[22] Filed: Mar. 22, 1996

[30] Foreign Application Priority Data

Mar. 22, 1995 [FI] Finland ..... 951351

[51] Int. Cl.[6] ..... H01P 7/00

[52] U.S. Cl. ..... 333/219; 333/204; 333/233; 333/175

[58] Field of Search ..... 333/202, 203, 333/204, 206, 207, 219, 235, 174, 175

[56] References Cited

U.S. PATENT DOCUMENTS

| | | | |
|---|---|---|---|
| 4,182,997 | 1/1980 | Brambilla | 333/202 |
| 4,264,881 | 4/1981 | De Fonde | 333/204 |
| 4,418,324 | 11/1983 | Higgins | 333/204 |
| 4,449,108 | 5/1984 | Endo et al. | 333/202 |
| 5,047,739 | 9/1991 | Kuokkanen | 333/219 |
| 5,107,233 | 4/1992 | Stoft | 333/202 |
| 5,184,096 | 2/1993 | Wakino et al. | 333/202 |
| 5,298,873 | 3/1994 | Ala-Kojola | 333/202 |
| 5,432,489 | 7/1995 | Yrjola | 333/202 |
| 5,543,764 | 8/1996 | Turunen | 333/202 |

FOREIGN PATENT DOCUMENTS

| | | | |
|---|---|---|---|
| 2 248 621 | 10/1974 | France | H01P 3/08 |
| 1 171 479 | 3/1963 | Germany . | |
| 24 07 313 A1 | 2/1974 | Germany | H01P 1/20 |
| WO 89/05046 | 6/1989 | WIPO | H01P 7/04 |

OTHER PUBLICATIONS

European Search Report dated 29 May 1996.

8056 Journal of Physics E. Scientific Instruments—vol. 17(1984) Jan., No. 1, dorking, Great Britain (J. Phys. E: Sci. Instrum., vol. 17, 1984).

*Primary Examiner*—Robert Pascal
*Assistant Examiner*—Darius Gambino
*Attorney, Agent, or Firm*—Darby & Darby

[57] ABSTRACT

The invention relates to a resonator coupling and a radio frequency filter, which comprise a transmission line resonator (106), preferably a helix resonator, having an upper and lower end, a transmission line (108, SL3) for coupling to the resonator, and a tap point (121), at which the transmission line (108, SL3) and the transmission line resonator (106) are in direct contact with each other, whereby the transmission line (106) is divided at the tap point (121) into a lower and upper part, the lower part comprising a first part (SL1) and the upper part comprising a second part (SL2). A coupling element (SL4) is placed at the tap point (121) in parallel with the transmission line resonator (106), coupled (M1) electromagnetically to the transmission line resonator (106), thus improving the stop/pass ratio of the filter. In addition, a second transmission line (SL5) can be arranged in parallel with the coupling element, coupled (M2) to said coupling element (SL4), whereby said coupling (M2) compensates for the resonating frequency change of the helix resonator with respect to the temperature.

16 Claims, 8 Drawing Sheets

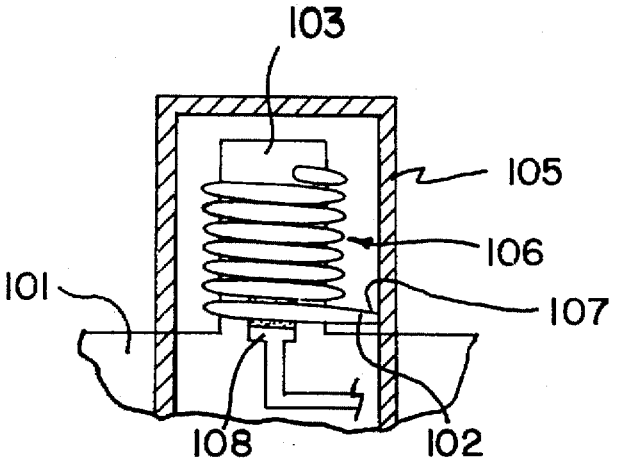
FIG. 1
(PRIOR ART)
FIG. 2
(PRIOR ART)
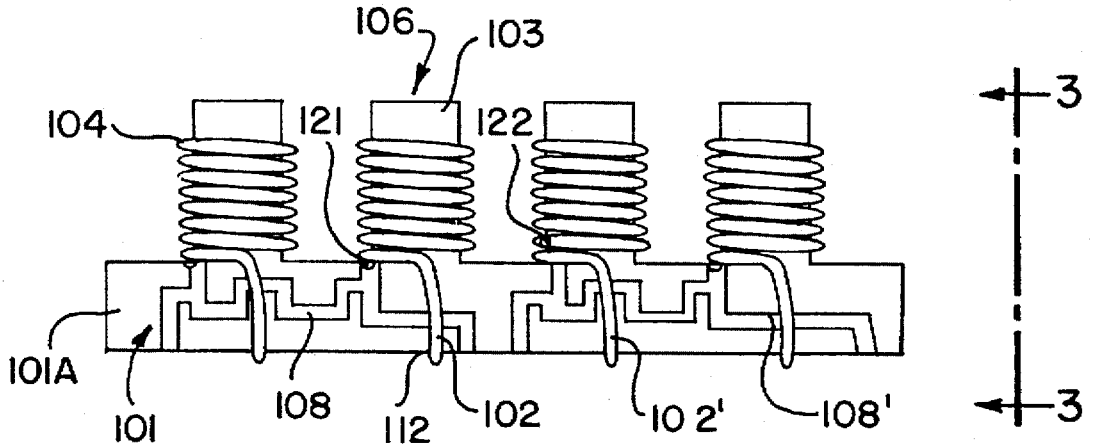
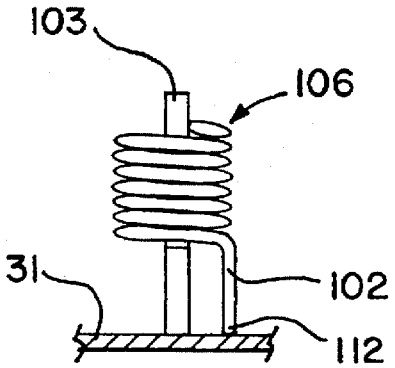
FIG. 3
(PRIOR ART)

FILTER WITH IMPROVED STOP/PASS RATIO

FIELD OF THE INVENTION

The present invention relates to a resonator coupling and a radio frequency filter comprising a transmission line resonator, preferably a helix resonator, with a top and a bottom end, a transmission line for coupling to the resonator and a tap point where the transmission line and the transmission line resonator are in direct contact with each other, the transmission line resonator thereby being divided at the tap point into two parts: the first part being the part from the tap point to the bottom end and the second part being the part from the tap point to the top end.

BACKGROUND OF THE INVENTION

In radio transceivers it is generally used duplex filters based on transmission line resonators to prevent the transmitted signal from entering the receiver and the received signal from entering the transmitter. Each multichannel radio telephone network has a specified transmission and reception frequency band. The difference between the reception and transmission frequencies during connection, i.e. the duplex interval, also complies with the network specifications. The frequency difference between the pass band and stop band of an ordinary bandpass or bandstop filter is also called a duplex interval. It is possible to design a filter suitable for each network. Current manufacturing methods enable flexible and economic production of different network-specific filters. The frequency adjustment methods, or the so-called switching methods, aim at dividing the networks into blocks, thereby making it possible to cover the whole frequency band by one smaller filter designed for one block only. The filter is always switched to the block in use, in other words, adjusted to the frequency range in use.

A helix resonator is a transmission line resonator widely used in filters of the high-frequency range. A quarter-wave resonator comprises inductive elements which include a conductor wound into a cylindrical coil with one end short-circuited, and a conductive casing surrounding the coil. The conductive casing is connected to the low-impedance, short-circuited end of the coil. The capacitive element of the resonator is formed between the open end of the coil and the conductive casing surrounding the coil. Coupling to the resonator can be made either capacitively at the top end of the resonator coil where the magnetic field is strong, or inductively at the bottom end of the resonator coil where the magnetic field is strong, or by using a coupling hole. The latter is used between two resonators. Inductive coupling is made when the wire to be connected is terminated with a loop coupler which is positioned in a strong magnetic field in the resonator. The bigger the loop coupler and the stronger the resonator magnetic field in the loop coupler, the more effective the coupling.

Filters with helix resonators are lightweight and have good electrical characteristics and are therefore widely used in radio devices. The resonator is a transmission line resonator comprising a conductor, the length of which is about a quarter of a wavelength, wound into a cylindrical coil and placed inside a grounded metal casing. The specific impedance of the resonator and, hence, the resonating frequency are determined by the physical dimensions of the cavity, the ratio of the diameter of the helix coil to the inner dimension of the casing, the distance between the turns in the coil, i.e. pitch, and the supporting structure possibly used to support the coil. Therefore, to manufacture a resonator to resonate at exactly the desired frequency requires precise and accurate construction.

By cascading resonators and arranging the coupling between them as appropriate, it is possible to have a filter with desired properties. As the sizes of the filters decrease, especially in portable radio devices, the accuracy requirements set for the production and assembly become more strict, since even the smallest dimensional deviations in the cavity, cylindrical coil and supporting structure will greatly affect the resonating frequency. When connecting a filter to the electric circuit of a radio device, its input and output ports must be matched to the circuit, i.e. the impedances from the ports to the direction of the filter are made equal with the impedances from the ports to the direction of the circuit, lest there occur in the ports reflections and, hence, transmission losses caused by a sudden impedance change. Likewise, the resonators of the filter have to be matched to each other if the signal is brought to the filter by a physical coupling to its helix coil.

So a suitable impedance level has to be found in the resonator, i.e. a physical point of connection at which the impedance level from the point of connection to the resonator equals that of the device connected thereto or that of the adjacent resonator. The impedance level of the point of connection is directly proportional to the distance of the point of connection from the short-circuited end of the resonator, whereby a higher or lower impedance level can be selected by moving the point of connection in the helix coil. This kind of matching is called tapping because the point of connection forms a tap point from the helix resonator. The tap point can be determined by experimentation or by calculation using calculated or measured specific impedance of the resonator, which, in turn, depends on the characteristics of the resonator. Often the tap point in the helix resonator is made in its first turn.

Traditionally, tapping has been made by soldering or welding one end of a separate coil or conductor to the wire forming the helix resonator at the tap point. With decreasing filter sizes, the reproduction fidelity has been found inadequate for series production when using this kind of tapping. Inadequate accuracy in tapping results in a need for adjusting the tapping when tuning the filters, which increases tuning time and costs.

A better tapping method is presented in the Finnish Patent 80542. The principle is shown in attached FIG. 1. A helix resonator 106 is placed around a fingerlike projection 103 of an insulator board 101 so that the projection is inside the resonator coil and supports the coil. The beginning of the first turn of the coil 106 at the end nearest to the insulator board 101 is bent so as to form a straight portion 102 which for its whole length is placed tightly against the surface of the insulator board. This straight portion is called the resonator's leg. The end 107 of the portion 102 is short-circuited to a casing 105 through this point. At the foot of the projection 103 on the insulator board there is a microstrip conductor 108 which is connected to the rest of the resonator circuit or forms part of a more extensive microstrip pattern on the insulator board. The microstrip runs in the direction of the coil axis. The tap point is then the location where the microstrip 108 intersects the straight portion 102 of the coil. The strip and the straight portion are soldered to each other at this location. The tap point and, hence, the desired impedance level can be selected by moving the microstrip 108 sideways.

A disadvantage of this method is that to change the impedance level of the tap point one has to have several insulator boards differing from each other with respect to the horizontal location of the microstrip. That is a cost-increasing factor. Another disadvantage is that it is impossible to fine-tune the tap point since the leg must be placed against the insulator board. A leg against the insulator board is not a very good solution in practice because when the leg is against a lossy board, it increases the resonator losses.

A filter is well known from prior art in which the tapping is made to a strip line connected to the edge of the fingerlike projection described above. Such a filter is depicted in FIGS. 2, 3, and 4 in which the same reference numbers are used as in FIG. 1. where applicable. FIG. 2 shows a part inside the casing of a four-circuit filter. comprising four discrete helix resonators—resonators 106 and 107 are separately referenced to—each of which is positioned around the fingerlike projections 103 of a printed board 101. This is usually referred to as a comb structure. On the lower part 101A of the insulator board 101 there is an electric circuit formed by strip lines 108 and 108', into which one or more resonators, like resonator 106. are connected by soldering at the tap point 121. In this case, the tap point is located at the first turn of the coil, but it could be located higher up just as well. This possibility is illustrated with the resonator 107 in FIG. 2, in which the tap point 122 is located at the second turn of the coil. Then the strip line extends on the fingerlike projection a little way up and stops at the edge of the projection where it is soldered to the resonator turn located at that position.

Thus, the tap point may be located at any resonator turn and there may even be several tap points. Unlike in FIG. 1, the straight leg 102 of the resonator is bent parallel to the resonator axis and runs at a distance from the insulator board and its one end is attached in the assembly phase to the bottom plate 31 of the casing, FIG. 3. and is grounded there if the casing is made of metal. The bottom plate of the casing may also comprise a printed board of a radio device, with at least one surface at the location of the filter plated throughout, whereby the tip of the leg is connected to the plated surface.

FIG. 4 shows a completed filter according to prior art, with the filter casing 41 partly cut open so that the resonator can be clearly seen. This filter has partitions between the circuits, with partitions 42 and 43 showing, which may have coupling holes (not shown) through which a circuit can be connected to the adjacent circuit by means of an electromagnetic field. The partitions are unimportant from the point of view of the invention, as is the fact how the insulator board supporting the resonators is attached to the walls of the casing. In most cases, the casing 41 is an extruded aluminum casing, and the bottom plate 44 may be a metal plate or a printed board with one surface plated. The tap points 21 and 22 of the helix resonators 6 and 7 shown are represented by black dots, and the resonator is connected at this tap point to the lower part 101A of the insulator board and to the strip line circuit (not shown) formed on the fingerlike projections 103. The tips 112 and 113 of the legs 102 and 102' are soldered to the bottom plate 44 if it or its surface is metal, or they are conductively connected to a metal foil on the opposite side of the bottom plate if the bottom plate is a printed board.

FIGS. 5*a* and 5*b* show the wiring diagram of a tapped resonator, like the resonator 106 depicted in FIG. 2. FIG. 5*a* shows the wiring diagram of the electric equivalent circuit of the tapped resonator 106, in which the resonator coil forms a quarter-wavelength transmission line 106, to the low-impedance end of which, at the location 121, it is connected a coupling inductance 108 for the coupling to/from the resonator. Because of the tapping the transmission line 106 is divided into two separately examined transmission lines SL1 and SL2, as shown in FIG. 5*b* in which the transmission line connected to the tap point 121 is marked SL3 (=coupling inductance 108).

FIG. 6 shows the wiring diagram of a typical (low-pass type) band-stop filter implemented with three resonators, e.g. helix resonators. Usually in a band-stop filter the couplings between resonators are implemented inductively. The coils L4, L5 represent the inductive couplings between the circuits of the filter. As is known, the coupling between the resonators can also be made capacitive, using e.g. a so-called coupling hole. HX1, HX2, and HX3 represent transmission line resonators, preferably helix resonators, and L1, L2, and L3 represent coupling inductances for the coupling to the resonators/from the resonators to the input and output ports of the filter which often have impedances of 50 ohms.

A desired stop/pass ratio for the filter can be selected by changing the tapping height. The optimal situation is achieved by adjusting the duplex interval overlong, whereby the pass attenuation peak is drifted outside the operating frequency range. This situation is illustrated in FIG. 7, in which curve P represents the transmission attenuation of a band-stop filter and, more specifically, the pass attenuation characteristic in which the desired pass attenuation range is between references 1 and 2, i.e. here in the range 452.5 to 454.2 MHz. This shows that the pass attenuation peak T falls out of the pass attenuation range. Curve E represents the transmission attenuation of the filter and, more specifically, the stop attenuation in which the desired stop attenuation range of the filter is between references 3 and 4, i.e. here about 462.5 to 464.2 MHz. The duplex interval is the distance between references 2 and 4, which in FIG. 7 is about 10 MHz. Curve H in FIG. 7 is the return loss characteristic of the filter, showing the impedance matching of the filter and the losses caused by the matching. Vertically, the scale of the grid in FIG. 7 is 10 dB/square for curves E and H, whereby the attenuation in the stop band is about 60 dB, and 0.5 dB/square for curve P. The arrowheads on both sides of the upper part of the figure show the zero level (0 dB), and in the case of FIG. 7, the pass attenuation in the pass attenuation range is then (at its worst=at the location indicated by reference 2) 2.0197 dB. Horizontally, the grid in FIG. 7 is at 443.0 MHz in the left-hand edge and at 476.33 MHz in the right-hand edge, and the spacing of the squares is 3.33 MHz. The duplex interval may be shortened by lowering the tapping height in the resonators, thereby decreasing the transmission line SL1 and correspondingly increasing the transmission line SL2. Then the pass attenuation peak T appears in the middle of the operating frequency range but at the same time the impedance level of the tap point drops to a low level, which is disadvantageous for the filter performance and causes considerable matching losses. As a result, it is obtained a filter with a pass attenuation on the leading edge about the same as before shortening the duplex interval, but whose characteristics elsewhere in the frequence range are worse than before lowering the tapping height. This is shown in FIG. 8, in which the pass attenuation P in the pass attenuation range is (at its worst=at the location indicated by reference 2) 2.01 dB. The scaling in FIG. 8 is the same as in FIG. 7. Furthermore, lowering the tapping height causes the tolerance of the transmission line SL1 to become tighter, which will result in a greater uncertainty in filter manufacturing. It is a disadvantage of the coupling by tapping that, because of the fixed direct contact, the input impedance and, hence, the coupling intensity cannot be adjusted at all.

SUMMARY OF THE INVENTION

It is the object of the present invention to avoid the disadvantages mentioned above. To achieve this, a capacitive coupling element is connected according to the present invention in parallel with the tap connection of the helix resonator (in addition to the tapping), with which the duplex interval of a filter formed by helix resonators can be shortened and at the same time the stop/pass ratio of the filter improved.

Accordingly, it is characteristic of the invention that a coupling element is placed in parallel with the transmission line resonator at the tap point, coupled electromagnetically to the transmission line resonator.

The capacitive coupling element is coupled at the tap connection in parallel with the transmission line resonator so as to be coupled to the transmission line resonator through the portion between the tap connection and the open capacitive end of the resonator (marked SL2 in FIG. 5*b*). The capacitive coupling element is preferably a transmission line capacitively coupled to a helix resonator.

In addition, the coupling according to the invention may include another resonator short-circuited at its both ends, so that it, too, is coupled to said capacitive coupling element (transmission line), whereby a temperature-compensated structure is also achieved which compensates for the frequency change of the helix resonator with respect to the temperature. This second resonator may be a resonator coupled to the electromagnetic field of the main resonator according to patents FI-88442 and U.S. Pat. No. 5,298,873, but in the invention this second resonator is coupled so that it is also coupled to said capacitive coupling element (transmission line), thereby achieving a temperature-compensated structure which compensates for the frequency change of the helix resonator with respect to the temperature. In other words, the additional resonator performing the temperature compensation may also at the same time be coupled to the main resonator according to patents FI-88442 and U.S. Pat. No. 5,298,873.

In the above-mentioned patents FI-88442 and U.S. Pat. No. 5,298,873 a method and an arrangement are presented with which the resonating frequency of a resonator can be easily changed. In the method, it is placed in the electromagnetic field of the main resonator a second resonator which is coupled to the input of a controlled switch. By coupling the switch to the ground the second resonator is short-circuited at that end and becomes a half-wave resonator or quarter-wave resonator depending on whether the other end is open or short-circuited. This change will be reflected as a change in the resonating frequency of the main resonator.

BRIEF DESCRIPTION OF THE DRAWINGS

The invention is described in greater detail with reference to the attached drawing, where:

FIG. 1 shows a known resonator tapping,

FIG. 2 depicts the resonators of a known four-circuit filter,

FIG. 3 is a side view of one of the resonators in FIG. 2,

DETAILED DESCRIPTION OF THE PREFERRED EMBODIMENTS

FIGS. 1 to 8 illustrating prior art techniques were already discussed above, so the invention is below described referring mainly to FIGS. 9 to 12*b*.

Figure 4:
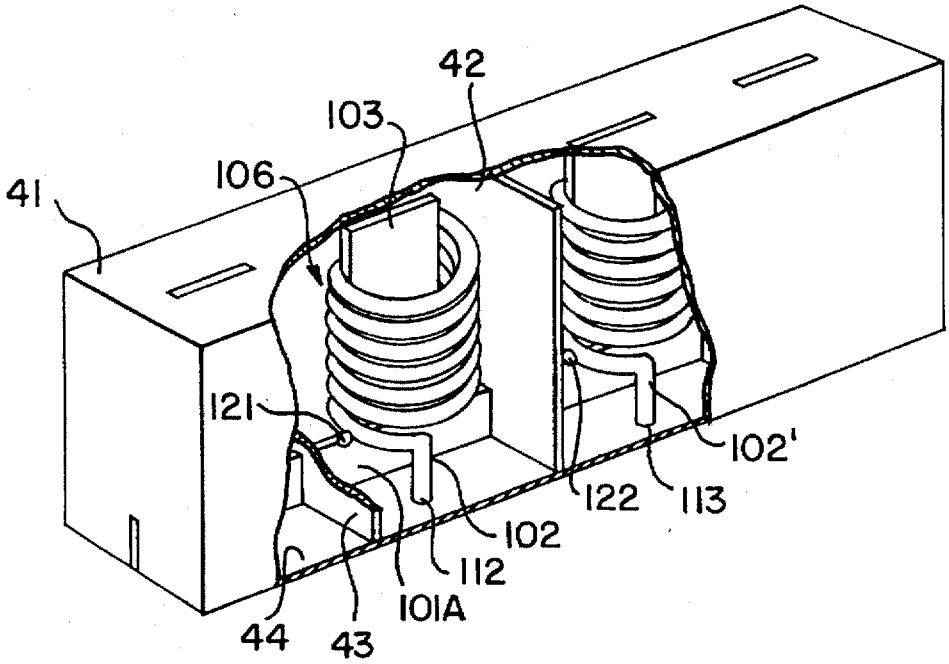
FIG. 4 (PRIOR ART)
FIG. 4 depicts a known filter cut partly open.
Figure 5A:
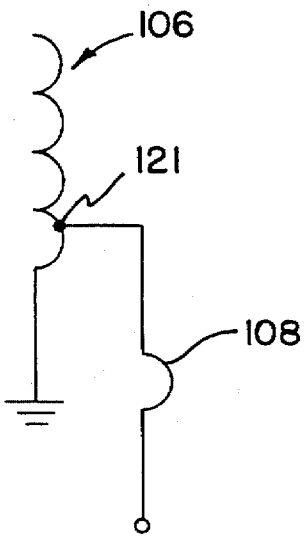
FIG. 5a (PRIOR ART)
FIG. 5*a* is a wiring diagram of a tapped resonator.
Figure 5B:
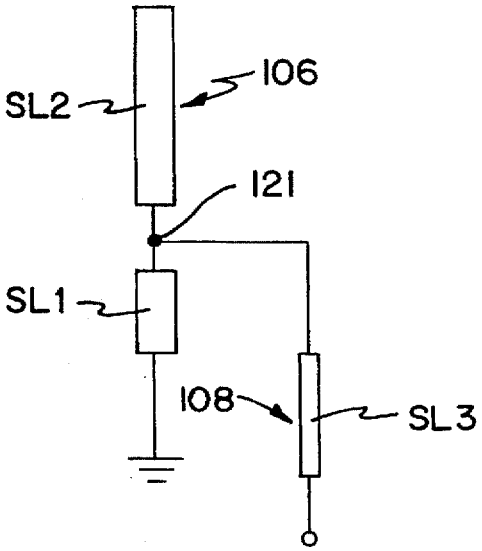
FIG. 5b (PRIOR ART)
FIG. 5*b* is an equivalent circuit of a tapped resonator.
Figure 6:
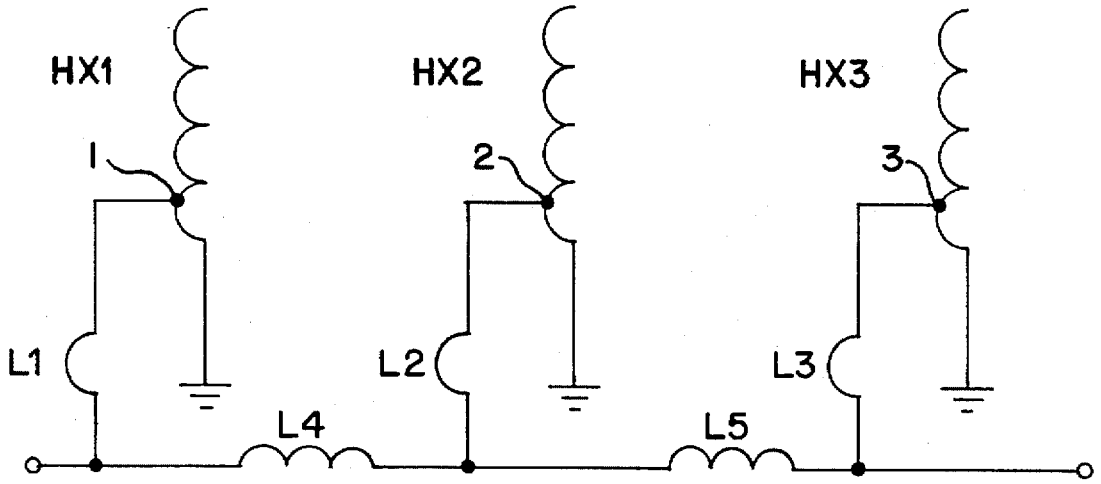
FIG. 6 (PRIOR ART)
FIG. 6 is a wiring diagram of a known band-pass filter comprising two resonators.
Figure 9:
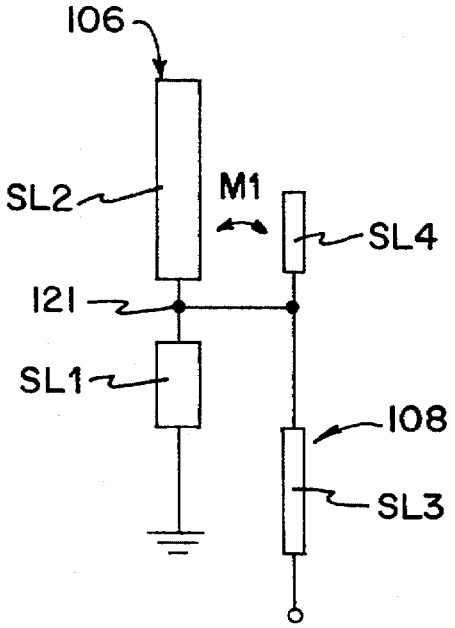
FIG. 9 shows the equivalent circuit of a resonator coupling according to the invention.

FIG. 9 shows the wiring diagram of a resonator coupling according to the invention, with a resonator 106 forming a quarter-wavelength transmission line 106, to the low-impedance end of which, at location 121, it is connected a coupling inductance 108 serving as a transmission line SL3 used for coupling to/from the resonator. Tapping divides the resonator transmission line 106 into two transmission lines SL1 and SL2. According to the invention, a capacitive coupling element SL4 (coupling M1) is connected in parallel with the tap connection 121 of the resonator, preferably a helix resonator 106, (in addition to the tapping), enabling the shortening of the duplex interval of the duplex filter consisting of helix resonators and at the same improving the stop/pass ratio of the filter. The capacitive coupling element SL4 is connected at the tap connection 121 in parallel with the transmission line resonator 106 so as to be coupled (coupling M1) to the transmission line resonator 106 through the portion SL2 between the tap connection 121 and the open capacitive end of the resonator. The capacitive coupling element is preferably a transmission line SL4 coupled capacitively to a helix resonator. Since the transmission line SL4 is connected to the same point with the tapping, the coupling to the resonator structure requires no extra connections.

Figure 7:
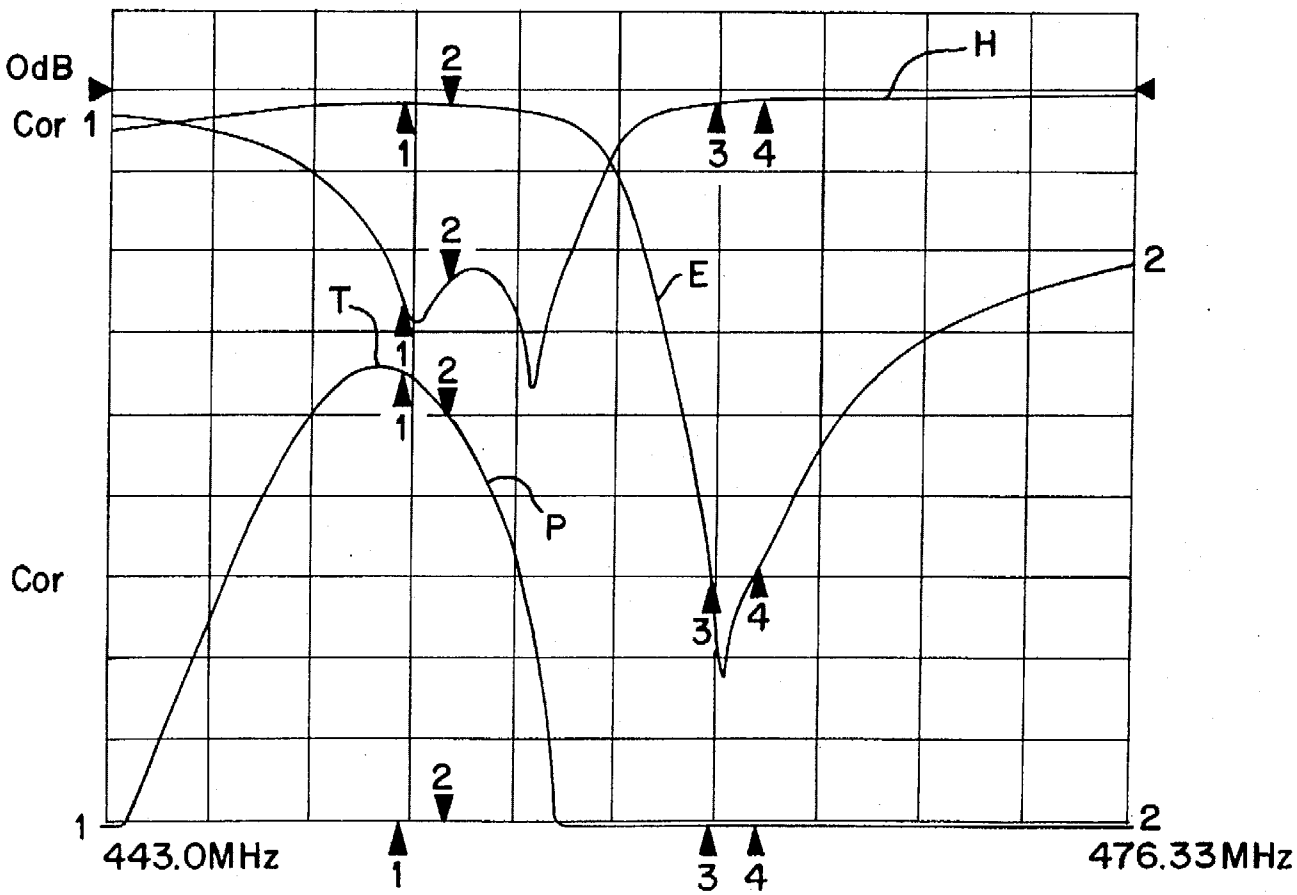
FIG. 7 (PRIOR ART)
FIG. 7 shows the transfer function of a band-stop filter with a duplex interval adjusted overlong.
Figure 8:
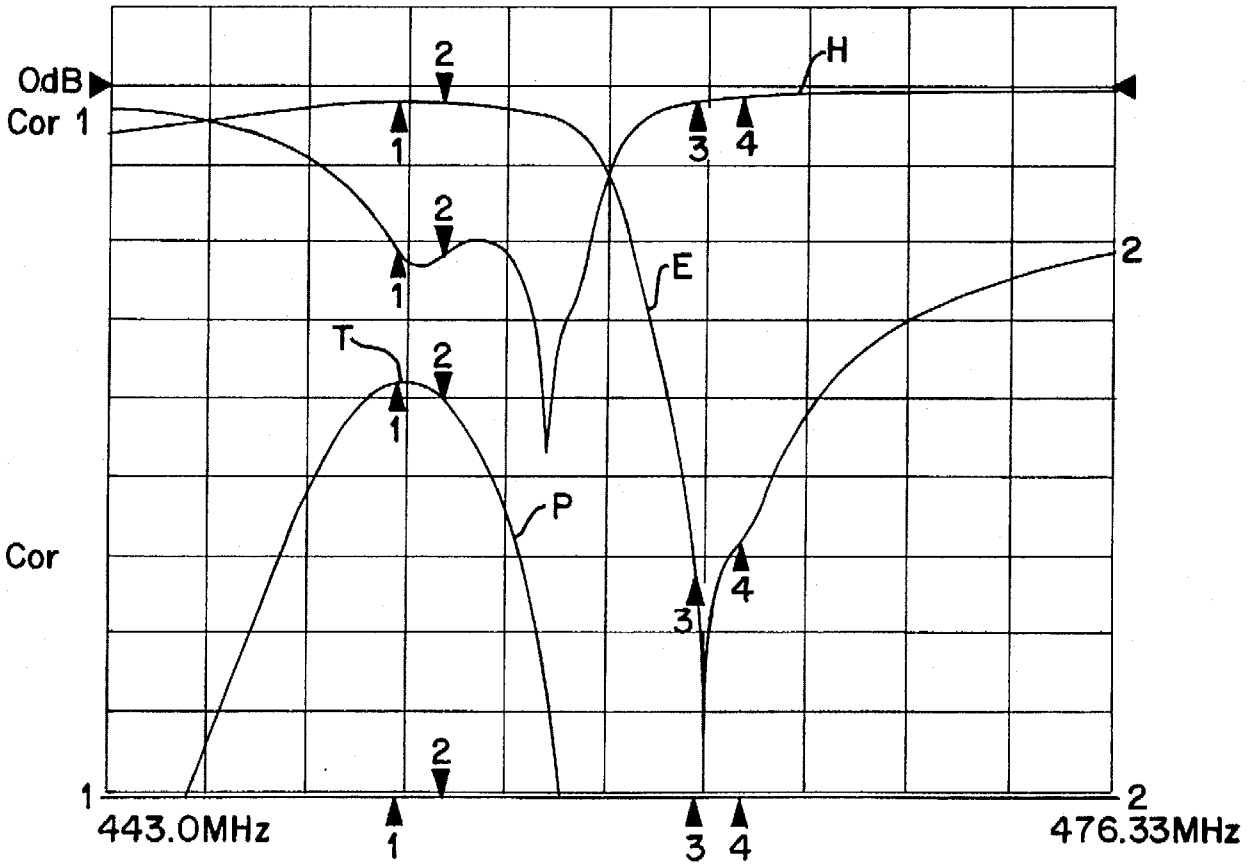
FIG. 8 (PRIOR ART)
FIG. 8 shows the transfer function of a band-stop filter with a shorter duplex interval obtained by lowering the tapping height.
Figure 11:
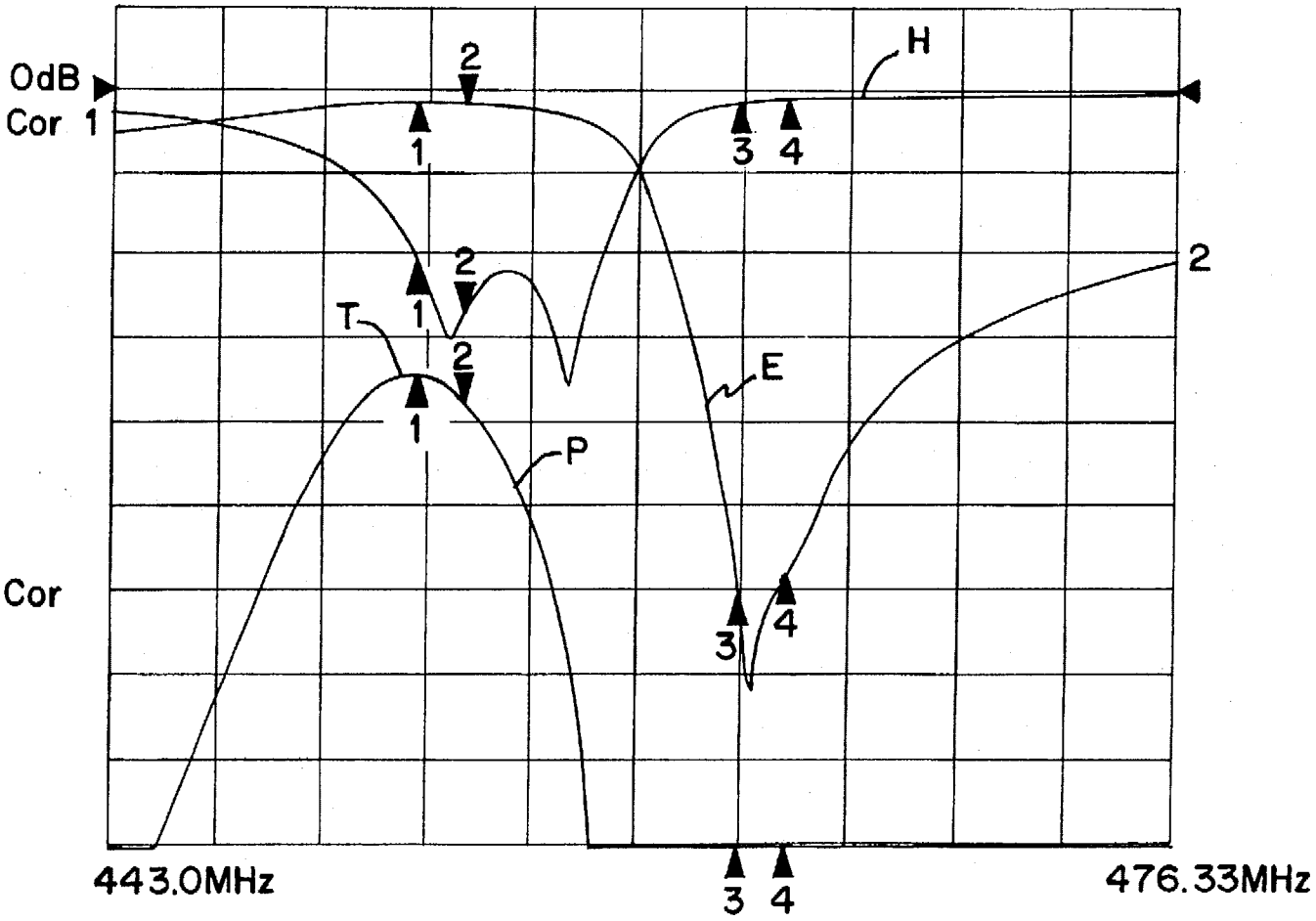
FIG. 11 shows the transfer function of the resonator coupling shown in FIG. 10.

With the arrangement according to the invention the pass attenuation peak T can be moved in the direction of the operating frequency range (i.e. toward references 1 and 2) without impairing the pass peak throughout. This is shown in FIG. 11 where we can see that the pass attenuation peak T has shifted considerably from the original position (FIG. 7). The scale is the same as in FIGS. 7 and 8. As a result, the pass attenuation at reference 2 is 1.9055 dB, which means that compared to FIG. 7 it has been improved by 0.1 dB at the leading edge. The stop attenuation has remained substantially the same, but the duplex interval has been shortened and the pass attenuation improved, and as a result of that the stop/pass ratio has been improved. Thus, the coupling M1 of the transmission line SL4 to the resonator part SL2 produces a shortening effect on the duplex interval while the impedance level of the connection point 121 of the resonator stays advantageous from the point of view of connecting the resonator to the rest of the operating environment. Then the matching losses will remain small and the benefit gained shows as an improved pass attenuation. By selecting a suitable coupling M1 the pass attenuation peak can be positioned exactly in the middle of the operating frequency range, hence making the stop/pass ratio optimal, whereby the total benefit in a filter using this kind of resonator coupling can be as much as 0.2 dB while the stop attenuation remains unchanged.

Figure 10:
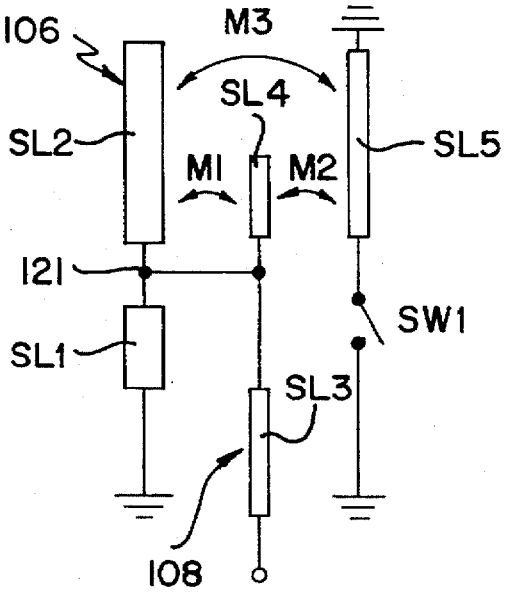
FIG. 10 shows the equivalent circuit of a resonator coupling with temperature compensation according to the invention.

In another embodiment of the invention, shown in FIG. 10, an extra resonator SL5 short-circuited at its both ends, can be placed in the coupling so that it, too, is coupled (coupling M2) to said capacitive coupling element (transmission line) SL4, whereby, since the transmission line SL4 is coupled to the inductive portion of the resonator (i.e. close to the low-impedance short-circuited end of the resonator), it is at the same time obtained a temperature-compensated structure which compensates for the frequency change of the helix resonator with respect to the temperature. This second resonator SL5 may be a resonator coupled at the same time to the electromagnetic field of the main resonator 106 (coupling M3), but here it is coupled so that it is also coupled (M2) to said capacitive coupling element (transmission line) SL4, thereby achieving a temperature-compensated structure which compensates for the frequency change of the helix resonator with respect to the temperature. The frequency of the helix resonator has a natural tendency to decrease when the temperature increases, i.e. when the resonator coil warms up. Nowadays, however, it is desirable that the resonating frequency of a resonator be adjustable, whereby a second switched resonator can be arranged in parallel with the main resonator, as presented in said patents FI-88442 and U.S. Pat. No. 5,298,873 and in this FIG. 10 as resonator SL5. This resonator SL5 usually comprises a capacitive coupling M3 to the main resonator 106, whereby the helix resonator becomes overcompensated as the coupling M3 decreases when the temperature rises, and the frequency of the helix resonator structure increases as the temperature rises. By placing a coupling element SL4 according to the invention in the structure this frequency increase can be compensated for. Correspondingly, the structure in FIG. 9 is undercompensated, whereby the frequency of the structure decreases as the temperature rises. This temperature-dependent behaviour can be compensated for by further placing a switched resonator SL5 in the structure, as shown in FIG. 10.

Figure 12A:
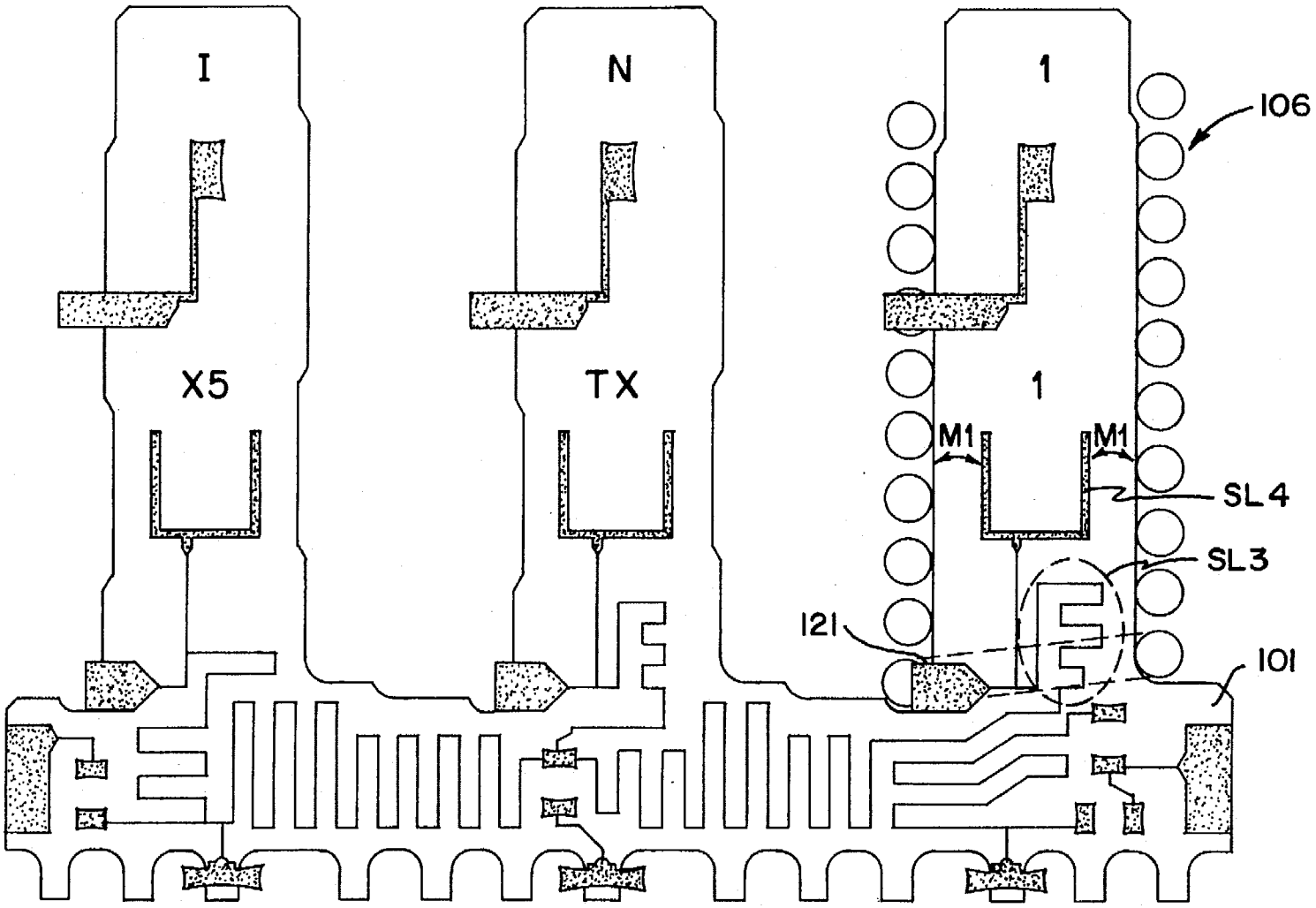
FIG. 12*a* shows a resonator coupling according to the invention implemented in a comb-structured helix filter.
Figure 12B:
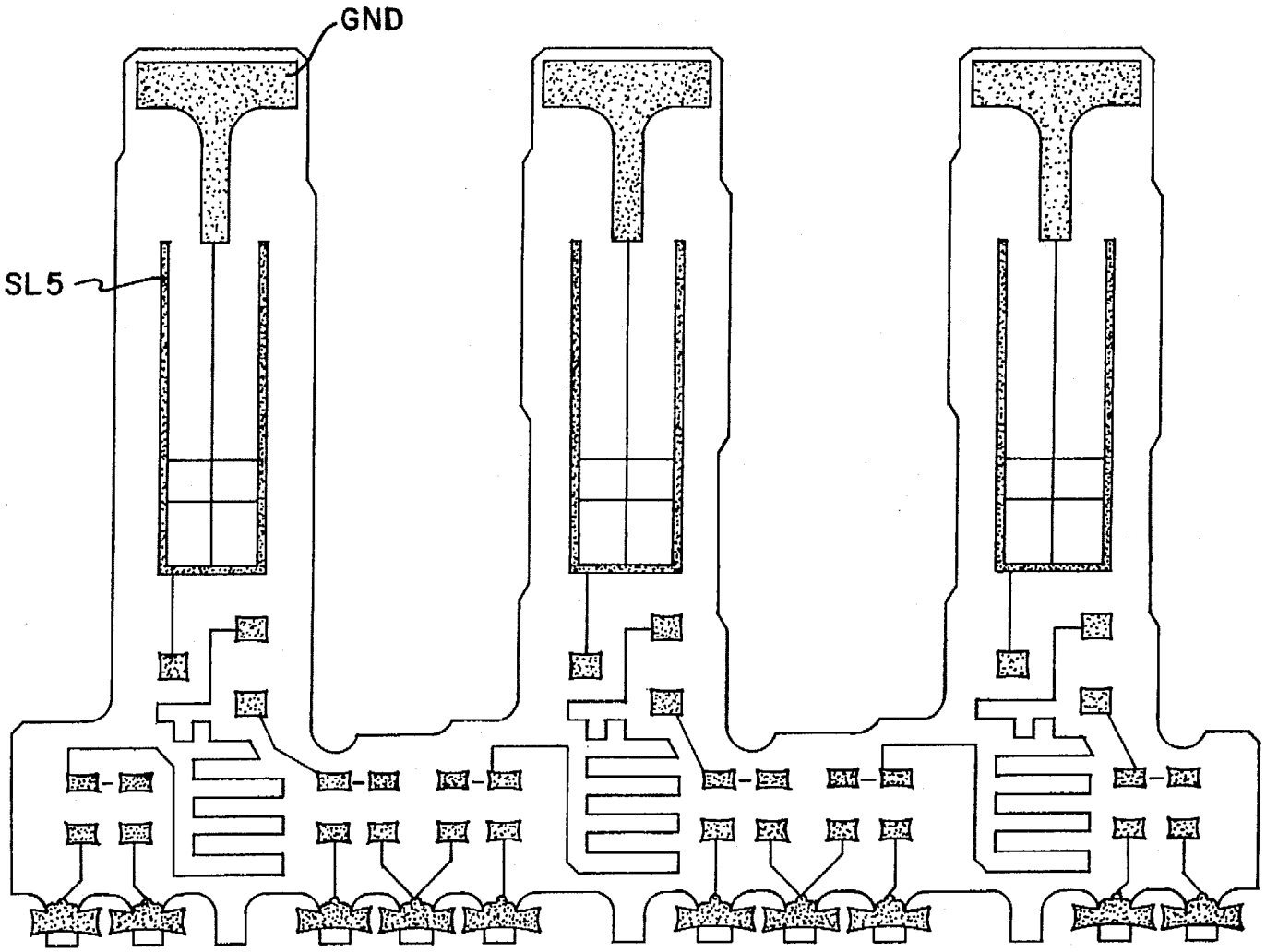
FIG. 12*b* shows the filter of FIG. 12*a* seen from the other side of the printed board.

FIGS. 12*a* and 12*b* show the implementation of the invention in a comb-structured helix filter, which in the example illustrated by FIGS. 12*a* and 12*b* comprises three helix resonators X5, TX and 1, which all are placed around fingerlike projections 103 of a printed board 101. In the lower part 101A of the insulator board 101 there is an electric circuit formed by microstrips 108 and 108', into which one or more resonators, like resonator 106, are connected at the tap point 121 by soldering; from which a coupling transmission line SL3 is connected to the input interface; and into which a transmission line SL4 is coupled according to the invention as a capacitive element, placed in this figure near the inductive end of the resonator. A coupling M1 is formed between the transmission line SL4 and resonator coil 106. According to the second embodiment of the invention, a strip line resonator SL5 can be placed on the other side of the insulator board 101, which is coupled to the resonator 106 via coupling M3 and through the insulator board 101 to the transmission line SL4, thus forming coupling M2 through the insulator board. The switch SW1 shown in FIG. 10 can be coupled to the three coupling pads shown in FIG. 12*b* below the transmission line SL5, whereby the switch is preferably a three-position switch, e.g. a diode. The big coupling pad in the upper part of the projection on the insulator board, to which the transmission line SL5 is connected, is the gounding.

In FIGS. 12*a* and 12*b* the resonator arrangement according to the invention is implemented in each resonator of the filter. That is not necessary, but the arrangement may be implemented e.g. in one, several or all resonators.

We claim:

1. A resonator coupling comprising:

a transmission line resonator having an upper end which is open-circuited, a lower end which is short-circuited, and a length substantially equal to a quarter wavelength of its resonant frequency;

a transmission line for coupling to the resonator;

a tap point at which the transmission line and the transmission line resonator are in direct contact with each other, said transmission line resonator is divided at the tap point into a first lower part and a second upper part; and a coupling element in parallel with said transmission line resonator at said tap point and being electromagnetically coupled to said transmission line resonator.

2. The resonator coupling of claim 1, wherein the first portion of the transmission line resonator is substantially shorter than the second portion.

3. The resonator coupling of claim 1, further comprising an insulator board having first and second sides, wherein said transmission line is a first strip line formed on the surface of the insulator board, and the coupling element is a second strip line arranged on said part of the insulator board on said first side.

4. The resonator coupling of claim 3, further comprising a third strip line placed on said second side of the insulator board and coupled electromagnetically to said first strip line through said insulator board.

5. The resonator coupling of claim 1, wherein said coupling element is arranged from the tap point in parallel with the second part of the transmission line resonator, and is coupled to said second part.

6. The resonator coupling of claim 5, wherein the coupling element is arranged from the tap point in the vicinity of the lower end of the second part of the transmission line resonator, and is coupled to an inductive portion of the transmission line resonator.

7. The resonator coupling of claim 1, wherein the coupling element is capacitively coupled to the transmission line resonator.

8. The resonator coupling of claim 1, wherein the coupling element is a transmission line.

9. The resonator coupling of claim 1, further comprising a second transmission line which is grounded at least at one end and is electromagnetically coupled to said coupling element.

10. The resonator coupling of claim 1, wherein the transmission line resonator is a helix resonator comprising a conductor wound into a cylindrical coil.

11. The resonator coupling of claim 10, further comprising an insulator board having first and second sides, wherein said conductor is wound around at least a part of the insulator board, said transmission line is a first strip line formed on the surface of the insulator board, and the coupling element is a second strip line arranged on said part of the insulator board on said first side.

12. The resonator coupling of claim 11, further comprising a third strip line placed on said second side of the insulator board and coupled electromagnetically to said first strip line through said insulator board.

13. A radio frequency filter comprising at least one transmission line resonator, said transmission line resonator comprising:

a transmission line resonator having an upper end which is open-circuited, a lower end which is short-circuited, and a length substantially equal to a quarter wavelength of its resonant frequency;

a transmission line for coupling to said resonator and said filter;

a tap point at which the transmission line and the transmission line resonator are in direct contact with each other, said transmission line resonator is divided at the tap point into a first lower part and a second upper part; and a coupling element in parallel with said trarismission line resonator at said tap point and being electromagnetically coupled to said transmission line resonator.

14. The resonator coupling of claim 13, wherein the first portion of the transmission line resonator is substantially shorter than the second portion.

15. The resonator coupling of claim 13, further comprising an insulator board having first and second sides, wherein said transmission line is a first strip line formed on the surface of the insulator board, and the coupling element is a second strip line arranged on said part of the insulator board on said first side.

16. The resonator coupling of claim 15, further comprising a third strip line placed on said second side of the insulator board and coupled electromagnetically to said first strip line through said insulator board.

* * * * *